US005769900A

United States Patent [19]

Hahn et al.

[11] Patent Number: 5,769,900

[45] Date of Patent: Jun. 23, 1998

[54] ENZYME MIXTURES AND PROCESSES FOR DESIZING TEXTILES SIZED WITH STARCH

[75] Inventors: Wilfried Hahn, Nienburg/Weser; Axel Seitz, Hemmingen; Martin Riegels, Leichlingen; Rainhard Koch, Köln; Michael Pirkotsch, Leverkusen, all of Germany

[73] Assignees: Bayer Aktiengesellschaft, Leverkusen; Genencor International GmbH, Nienburg, both of Germany

[21] Appl. No.: 787,554

[22] Filed: Jan. 22, 1997

[30] Foreign Application Priority Data

Jan. 29, 1996 [DE] Germany ..... 196 03 054.4

[51] Int. Cl.[6] ..... D06M 16/00

[52] U.S. Cl. ..... 8/138; 435/263

[58] Field of Search ..... 8/138; 510/320, 510/321, 392, 393; 252/8.83, 8.86, 8.91; 435/263, 202, 203, 204, 205

[56] References Cited

U.S. PATENT DOCUMENTS

| | | | |
|---|---|---|---|
| 3,922,196 | 11/1975 | Leach et al. . | |
| 4,195,974 | 4/1980 | Kothe et al. . | |
| 4,371,372 | 2/1983 | Weible . | |
| 4,391,745 | 7/1983 | Denkler et al. . | |
| 4,457,760 | 7/1984 | Cholley . | |
| 4,536,182 | 8/1985 | Tatin | 8/138 |
| 4,643,736 | 2/1987 | Cholley . | |
| 4,921,795 | 5/1990 | Bozich, Jr. . | |
| 5,209,938 | 5/1993 | Kraus et al. | 426/20 |

FOREIGN PATENT DOCUMENTS

| | | |
|---|---|---|
| 0055664 | 7/1982 | European Pat. Off. . |
| 0119920 | 9/1984 | European Pat. Off. . |
| 0276806 | 8/1988 | European Pat. Off. . |
| 0540421 | 5/1993 | European Pat. Off. . |
| 2735816 | 2/1979 | Germany . |
| 2836516 | 3/1980 | Germany . |
| 2909396 | 9/1980 | Germany . |
| 4125969 | 2/1993 | Germany . |
| 9119794 | 12/1991 | WIPO . |
| 9419454 | 9/1994 | WIPO . |

OTHER PUBLICATIONS

I–C. Kim, et al., Synthesis of Branched Oligosaccharides from Starch by Two Amylases Cloned from–Bacillus licheniformis, Biosci. Biotech. Biochem., 58, (2), pp. 416–418, (1994). (Month Unknown).

Chemical Abstracts No. 109:145259v for EP 276806, Aug. 1988.

Chemical Abstracts No. 92:182530c for DE 2836516, Mar. 1980.

Chemical Abstracts No. 118:146258s for DE 4125969, Feb. 1993.

Chemical Abstracts No. 113:61270m for JP 2–80,673, Mar. 1990.

Chemical Abstracts No. 121:282294q for JP 6–235,163, Aug. 1994.

*Primary Examiner*—Alan Diamond

*Attorney, Agent, or Firm*—Sprung Kramer Schaefer & Briscoe

[57] ABSTRACT

Mixtures of various starch-degrading enzymes (amylases) which comprise at least one high temperature amylase (HTA) and at least one low temperature amylase (LTA) in an activity ratio of HTA to LTA of 10%:90% to 90%:10% develop at least 60% of their maximum activity in the temperature range from 30° to 90° C. Such mixtures can be diluted with water and treated with customary additives. These mixtures are suitable for desizing textiles sized with starch by treatment of the textiles with the mixtures mentioned and subsequent rinsing.

1 Claim, No Drawings

ENZYME MIXTURES AND PROCESSES FOR DESIZING TEXTILES SIZED WITH STARCH

BACKGROUND OF THE INVENTION

1. Field of the Invention

The invention relates to mixtures of various starch-degrading enzymes (amylases) which comprise at least one high temperature amylase and at least one low temperature amylase. The invention furthermore relates to a process for desizing textiles sized with starch, in which these textiles are treated with the enzyme mixtures mentioned.

Before production of woven fabric, textiles are charged with sizes. The sizes improve, or render possible for the first time, mechanical processing of the yarns in the weaving mill at high machine speeds. In the course of weaving, the warp of the woven fabric is exposed to considerably higher mechanical stresses than the weft. To avoid yarn breakages, the yarn must therefore be sized before the weaving process. Various materials can be employed as sizes, such as, for example, gelatin, linseed oil, carob bean gum and, increasingly in recent years, also synthetic materials, such as polyvinyl alcohols, polyacrylates and water-soluble cellulose derivatives, such as carboxymethyl cellulose. Although above all the synthetically prepared sizing agents mentioned last have technological advantages, even today starch is still one of the most important sizes for ecological reasons. In Europe, potato starch is employed above all, while overseas large amounts of maize starch and rice starch are used.

2. Description of the Related Art

Because of the different mechanical stresses, the sized warp and the sized weft of woven fabrics have different properties, which manifest themselves adversely, for example, in the bleaching process, during dyeing and in further treatment. For this reason, desizing of the woven fabric is absolutely essential before any further processing. While readily water-soluble sizes can already be removed by hot washing, starch withstands this simple process. The starch must be converted into a water-soluble form so that it can be washed out. In the relatively early years of use of starch, the desired effect of desizing was achieved by treatment with dilute sulfuric acid. However, this treatment very severely damaged the woven fabric. For this reason, enzymatic desizing, which is gentle on the fiber, rapidly found acceptance on the market.

Various starch-degrading enzymes (amylases) which are active either at temperatures of 30° to 70° C. (low temperature amylases) or at temperatures of 70° to 110° C. (high temperature amylases) are currently available for enzymatic desizing. They can be obtained from bacteria, fungi, plants or animals. The low temperature amylases are often starch-degrading enzymes which originate from Bacillus subtilis or Bacillus amyloliquefaciens. Corresponding enzymes from Aspergillus oryzae can also be employed. The high temperature amylases often originate from the bacterium Bacillus licheniformis. Either high or low temperature amylases must therefore by chosen for the process, depending on the temperature at which the desizing is carried out. There are as yet no products which comprise starch-degrading enzymes and universally have activity in all the customary temperature ranges.

DE-A 29 09 396 describes a desizing agent and a process for its preparation. The auxiliary comprises an intimate mixture of a starch-degrading enzyme with a surfactant in water. With the mixture described, the otherwise customary addition of a surfactant during desizing can be omitted. However, the desizing agent cannot be employed successfully over the entire temperature range, but requires a use temperature from 90° C. up to boiling point. JP 06/235 163 (1987; cited according to C.A. 121 (1994), 282294q) and JP 02/80 673 (1990; cited according to C.A. 113 (1990), 61270 m) describe enzymatic desizing with amylases at 100° to 115° C. or 50° C. Because of their very good heat stability, the amylases described in WO 94/19454 are suitable for desizing at high temperatures. DE-A 28 36 516 describes a process for cold desizing of textiles with α-amylases. WO 91/19794 describes an improved enzymatic desizing with α-amylases with addition of nonionic surfactants. A simultaneous hydrogen peroxide bleaching and enzymatic desizing is described by the Applications EP-A 55 664, EP-A 119 920 and U.S. Pat. No. 4,643,736 (sodium hypochlorite bleaching) and DE-A 27 35 816 ($H_2O_2$). U.S. Pat. No. 4,371,372 describes a combined dyeing and enzymatic desizing process at temperatures below 30° C.

It is now everyday practice in textile processing companies for lightweight textile goods which can be desized in the cold to be alternated with heavy goods, for which cold desizing is inadequate. Furthermore, the order situation brings, in irregular sequence, both small order batches, for which cold desizing again is preferred, and large order batches, for which continuous treatment under high temperature conditions is more economical. There is therefore a need for enzymatic desizing agents which can be used universally both in the high and in the low temperature technique of desizing and are more economical to store.

It has now been found that this requirement can be met by using the enzyme mixtures according to the invention described below. Surprisingly, it has additionally be found here that the enzymes of the mixture, which are supposedly unsuitable for work in both temperature ranges, in no way cause trouble, which would nevertheless have been expected because of their inertia in the supposedly "incorrect" temperature range and due to possible decomposition or degradation products in this "incorrect" temperature range. Rather, it has been found that, in practice, the presence of the enzymes suitable for two different temperature ranges has an unexpected synergism, which manifests itself in the fact that the mixture according to the invention needs to be employed in a smaller amount than a comparable special enzyme in order to achieve the desired effect. This represents an economic advantage which goes far beyond merely holding one instead of two desizing agents in stock.

SUMMARY OF THE INVENTION

The invention relates to mixtures of various starch-degrading enzymes (amylases) which comprise at least one high temperature amylase (HTA) and at least one low temperature amylase (LTA) in an activity ratio of HTA to LTA of 10%:90% to 90%:10%. It has more than 60% of its maximum activity in the temperature range from 30° to 90° C., and can furthermore be diluted with water and treated with customary additives.

DETAILED DESCRIPTION OF THE INVENTION

The ratio in which the HTA and LTA are mixed depends on their activity at the optimum temperature and pH. This is determined by the method of H. U. Bergmeyer (H. U. Bergmeyer, Methods for Enzymatic Analysis, 3rd Edition, Volume 2, pages 151–152, Verlag Chemie GmbH, Weinheim). Amylases hair:ng a maximum activity in the temperature range from 30° to 70° C. are called LTA.; amylases having a maximum activity in the temperature range from 70° to 110° C. are called HTA. The maximum activity of the individual LTA and HTA on the market are in each case in a very much narrower temperature range specific to the individual amylases.

The mixtures according to the invention comprise activity contents of 10% of HTA and 90% of LTA up to 90% of HTA and 10% of LTA. The activity ratios are preferably HTA:LTA=20%:80% to 80%:20%, particularly preferably 30%:70% to 70%:30%, especially preferably 40%: 60% to 60%:40%. Such mixtures develop 60% of their maximum activity in the range from 30° to 90° C. and accordingly mutually fill the activity gaps between the activity maxima of the HTA and the LTA. It is possible to employ smaller amounts of HTA/LTA mixture than would be necessary with a conventional amylase (cf. Examples). It is furthermore possible to employ less active and therefore cheaper amylases for the mixtures according to the invention. Even more, it is possible to keep in stock only one enzyme mixture according to the invention for a wide temperature range, instead of many enzymes, each of which are sufficiently active only in a specific and narrow temperature range.

Like other enzymes, the mixtures according to the invention can be diluted with water and treated with the customary additives.

The mixtures according to the invention furthermore preferably have at least 80% of the maximum activity in the temperature range from 45° to 75° C.

The invention furthermore relates to a process for desizing of textiles sized with starch by treatment of the textiles with starch-degrading enzymes (amylases) and subsequent rinsing, which comprises carrying out the treatment at 30° to 98° C. with a mixture of the type described above.

The desizing can be carried out either discontinuously (for example Jigger, cold pad-batch) and continuously (for example steamer).

The mixtures according to the invention can be prepared by simple mixing of the commercially available enzymes at room temperature. The mixtures can be diluted as desired both with demineralized and with normal tap water. The mixtures can furthermore comprise the customary standardizing agents and preservatives, for example alcohols, glycols or glycol ethers, such as 1-methoxy-2-propanol, isopropanol, butyldiglycol, sodium benzoate, calcium salts and isothiazolones, for example 5-chloro-2-methyl-3-(2H)-isothiazolone or 2-methyl-3-(2H)-isothiazolone.

Possible textiles to be desized according to the invention are, for example, those of cotton and cotton blend fabrics; cotton blend fabrics are, for example, those of cotton with polyester, polyamide, polyacrylonitrile or other cellulosic fibers, such as regenerated cellulose.

The activity of the mixtures according to the invention can be determined, for example, with soluble starch as the substrate at various temperatures in the above-mentioned range. The data of the following Table 1 were compiled with a desizing agent (mixture) according to the invention of an LTA from Bacillus amyloliquefaciens and an HTA from Bacillus licheniformis. The data obtained with the mixture are compared with those of another HTA (Aquazym 250 L, NOVO Nordisk), which is conventional and is already employed as an individual enzyme for desizing. It is not identical to the HTA contained in the mixture according to the invention.

The exact ratio in which the enzymes from the range of the HTA and that of the LTA are mixed depends on their optimum temperature and pH in an individual case; this can be determined by simple preliminary experiments. The activities can be determined, for example, by the method of H. U. Bergmeyer (loc. cit.).

To determine these activities, 200 μl of a 0.5% strength by weight starch solution (analytically pure; in 50 mmol potassium phosphate buffer at pH 7.3) were incubated with 50 μl of enzyme solutions of different dilution at 25° C., 60° C., 70° C. and 90° C. for 3, 10 and 30 minutes. At the end of the incubation period, 250 μl of a color reagent which had the following composition:

1.0 g of 3,5-dinitro-salicylic acid
20 ml of 2 mol NaOH
30 g of K Na tartrate·$4H_2O$
remainder to 100 ml $H_2O$ were added. The batch was incubated at 100° C. for 5 minutes and 2.5 ml of distilled water were then added. The extinction was determined at 546 nm against a nonincubated value. The activity was calculated as micromoles of reducing ends formed by enzymatic cleavage (calibrated with maltose) per minute. As far as possible, exclusively batches in which the increase in reducing ends was linear over the period of time in question were used for the calculation. The activities of the mixture described and of a conventional commercially available high temperature amylase were determined. The results are summarized in Table 1.

TABLE 1

Starch-degrading activities of a mixture according to the invention and another conventional HTA (Aquazym 250 L, NOVO Nordisk) at different temperatures by comparison (U = units)

| Product | Temperature (°C.) | Activity (U/ml) |
|---|---|---|
| HTA | 25 | 992 |
| Mixture | 25 | 4882 |
| HTA | 60 | 12174 |
| Mixture | 60 | 13876 |
| HTA | 70 | 17524 |
| Mixture | 70 | 13540 |
| HTA | 90 | 10480 |
| Mixture | 90 | 8151 |

The above table compares the activities of the mixture according to the invention with those of a conventional HTA at various temperatures. The conventional HTA is not the HTA which is a constituent of the mixture. Rather, it is an HTA which is available specifically for desizing at elevated temperatures. The activities were determined by the method of Bergmeyer (loc. cit.).

Both the mixture and the conventional HTA have about the same activity at 60° C. At 70° C., the conventional HTA is even more active than the mixture, and the same applies at 90° C.

In an experiment related to use, it has now been found, surprisingly, that the mixture according to the invention is considerably more suitable for desizing than the conventional HTA. In contrast to the results in Table 1, the mixture is thus snore active than the conventional HTA, although the desizing was carried out at high temperatures (90° C.).

Thus, only 40% of the amount necessary when the conventional HTA was employed was required of the enzyme mixture according to the invention for complete desizing. The mixture thus works far more effectively in practice than a conventional HTA (Examples 6 and 7). In practice, this means that for successful desizing, less of the mixture than of a conventional HTA has to be employed. The higher efficiency of the mixture according to the invention furthermore approximately halves the costs for the desizing agent.

EXAMPLES

Example 1

100% by volume of cotton gabardine with a fabric weight of 270 g/$m^2$ and a size deposit of 6%, comprising 90% of starch and 10% of polyacrylate, was treated with a mixture comprising 40% by volume of an HTA, 10% by volume of an LTA and 50% by volume of water. Desizing was carried out by the cold batch process with 1 ml/l of the mixture according to the invention with the addition of 2 ml/l of nonionic wetting auxiliary (90 parts of fatty alcohol polyglycol ether, 10 parts of water). The impregnating temperature was 20° C. and the liquor pick-up 90%. After a batching time of 6 hours, the fabric was rinsed in 3 passes, 1×90° C. alkaline, 1×90° C. neutral and once at 30° C. neutral. Evaluation was carried out in accordance with the TEGEWA violet scale: rating 7 to 8 (9=completely desized, 1=not desized).

Example 2

In comparison with Example 1, desizing was carried out by the hot batch process, under otherwise identical conditions. The impregnating temperature was 70° C. at a batching time of 2 hours and a liquor pick-up of 90%. Rinsing process as Example 1. The fabric was evaluated in accordance with the TEGEWA violet scale: rating 8.

Example 3

A 100% cotton woven fabric with a fabric weight of 150 g/m$^2$ and a size deposit of 9%, comprising 82% of starch, 13% of polyvinyl alcohol and 5% of pilling wax was treated with the mixture from Example 1 according to the invention. Desizing was carried out with 2 ml of the mixture according to the invention by the hot batch process with the addition of 2 ml/l of nonionic wetting agent (90 parts of fatty alcohol polyglycol ether, 10 parts of water). The goods were impregnated at 60° C. and squeezed off to a liquor pick-up of 90%, and were then batched up and, after a batching time of 3 hours, further processed analogously to Example 1. The evaluation was carried out in accordance with the TEGEWA violet scale: rating 9.

Example 4

A 100% cotton woven fabric with a fabric weight of 150 g/m$^2$ and a size deposit of 9%, comprising 82% of starch, 13% of polyvinyl alcohol and 5% of pilling wax were treated with the mixture from Example 1 according to the invention. Desizing was carried out with 2 ml/l of the mixture from Example 1 according to the invention by the hot batch process with the addition of 3 ml/l of nonionic wetting agent (90 parts of fatty alcohol polyglycol ether, 10 parts of water). The impregnating temperature was 60° C. at a liquor pick-up of 90% and a subsequent batching time of 12 hours. The material was washed with water at 90° C., 60° C. and finally at 30° C. Degree of desizing according to the TEGEWA violet scale: rating: 9.

Example 5

In a comparison experiment, the desizing mentioned under Example 4 was carried out with a customary HTA with the same activity with the addition of 3 ml/l of nonionic wetting agent. The degree of desizing was significantly lower (according to the TEGEWA violet scale: rating: 5).

Example 6

0.8ml/l of the mixture from Example 1 according to the invention was used on a continuously operating pretreatment unit with an impregnating, steaming and washing compartment. The fabric was impregnated at 70° C., and immediately thereafter steamed in a steamer at 98° C. for 40 seconds. The fabric was then subjected to hot washing out with the addition of 3 g/l of sodium carbonate, and rinsed in the cold. Degree of desizing according to the TEGEWA violet scale: rating: 9.

Example 7

A comparison experiment to Example 6 with 0.8 ml/l of a customary HTA (Aquazym 250 L (Novo Nordisk), which was not a constituent of the mixture according to the invention but had a similar activity, gave the following surprising result: in order to achieve desizing with the rating 9 according to the violet scale, 2.5 times the amount (2 ml/l) of the customary HTA had to be employed, compared with 0.8 ml/l according to Example 6. This resulted in a significant cost advantage when the mixture according to the invention was employed.

TABLE 2

Activity comparison (U = units)

| Enzyme | Amount employed (ml/l) | Activity (U)/ml 70° C. | Activity (U)/ml 90° C. | Activity (U)/amount employed 70° C. | Activity (U)/amount employed 90° C. | Degree of desizing according to the TEGEWA scale |
|---|---|---|---|---|---|---|
| Mixture | 0.8 | 13 540 | 8 151 | 10 832 | 6 521 | 9 |
| Customary HTA | 2.0 | 17 524 | 10 480 | 35 048 | 20 960 | 9 |

The table illustrates that, in spite of a lower enzyme activity, when determined by measurement, the mixture according to the invention gives a desizing result during use which is comparable to the customary HTA.

Example 8

400 kg of 100% cotton woven fabric with a fabric weight of 150 g/m$^2$ and a size deposit of 6.7%, comprising 100% of modified starch, were desized on a jigger with 1 ml/l of the mixture from Example 1 according to the invention. The liquor ratio was 1:6; after 2 passes at 90° C., the fabric was rinsed hot in 3 passes and in the cold in 2 passes. Degree of desizing according to the TEGEWA violet scale: rating: 8.

Example 9

The comparison experiment to Example 8 was carried out with 1 ml/l of a customary high temperature amylase; the fabric thus treated showed a degree of desizing with the rating 6 according to the TEGEWA violet scale.

What is claimed is:

1. A process for desizing textiles sized with starch, which comprises treating said textiles with a mixture of starch-degrading enzymes which comprises at least one high temperature amylase (HTA) and at least one low temperature amylase (LTA) in an activity ratio of HTA-to LTA of 10%:90% to 90%:10% and which has at least 60% of its maximum enzyme activity, in temperature range from 30° to 90° C., and which furthermore is optionally diluted with water and optionally further comprises standardizing agents and preservatives at 30° to 98° C. and rinsing.

* * * * *